United States Patent [19]

Belknap

[11] 4,031,970

[45] June 28, 1977

[54] BOREHOLE DRILLING APPARATUS

[76] Inventor: Billie E. Belknap, P.O. Box 846, Reedley, Calif. 93654

[22] Filed: Feb. 9, 1976

[21] Appl. No.: 656,362

[52] U.S. Cl. ..... 175/103; 175/215; 277/119

[51] Int. Cl.[2] ..... E21B 1/06; E21B 21/00

[58] Field of Search ..... 175/103, 212, 215; 277/110, 112, 115, 119, 123, 125; 166/75, 84; 173/78, 80

[56] References Cited

UNITED STATES PATENTS

| | | | |
|---|---|---|---|
| 1,862,260 | 6/1932 | Edmunds | 175/103 |
| 2,692,152 | 10/1954 | Tremolada | 277/119 |
| 2,764,387 | 9/1956 | Dionisotti | 175/212 |
| 2,896,980 | 7/1959 | Dicky | 277/119 |
| 2,914,306 | 11/1959 | Failing | 175/212 |
| 3,151,690 | 10/1964 | Grable | 175/212 |
| 3,297,100 | 1/1967 | Crews | 175/215 |
| 3,393,740 | 7/1968 | Seese et al. | 166/84 |
| 3,638,742 | 2/1972 | Wallace | 175/215 |
| 3,655,001 | 4/1972 | Hoffman | 175/215 |

*Primary Examiner*—James A. Leppink
*Attorney, Agent, or Firm*—Huebner & Worrel

[57] ABSTRACT

A borehole drilling apparatus having a pneumatically driven hammer mounting a bit, a drill pipe connected to the hammer to supply operating compressed air to drive the hammer and to blow drilling debris therefrom, and a debris conduit in spaced circumscribing relation to the drill pipe having an open end adjacent to the hammer to receive air and debris therefrom and a remote opposite end to discharge said air and debris through the conduit.

12 Claims, 10 Drawing Figures

BOREHOLE DRILLING APPARATUS

BACKGROUND OF THE INVENTION

The present invention relates to a borehole drilling apparatus and more particularly to such an apparatus which is pneumatically actuated and has improved facility for the removal of debris generated by the drilling operations.

Much of the world's agricultural production is dependent on irrigation from wells. Many additional areas could be productive if well irrigation could be made more generally available.

The manual digging of water wells is normally only feasible where the water level is relatively shallow and readily accessible. Most irrigation wells are mechanically drilled. Rotary augers are sometimes used where the drilling is in soil or hardpan but such augers are virtually useless in rocks. Bits which are raised by cable and dropped to punch through the earth have been popular for the drilling of water wells but cannot feasibly penetrate hard rocks and are extremely slow in rocks they can penetrate. Until the advent of pneumatically actuated, impact, well drilling equipment, the digging of wells in hard rock formations has been virtually impossible or economically unfeasible. Pneumatically actuated impact bits have proved capable of drilling through even hard rock formations at relatively good speeds but have long been subject to certain difficulties which the present invention has now succeeded in overcoming.

In drilling with a pneumatic hammer mounting an impact bit, such a hammer and bit are lowered on the end of a drill pipe and actuated by compressed air delivered through the pipe from the surface. The pneumatic hammer normally consists of a cylinder having a piston which is reciprocated by the compressed air and which mounts a cutting tool or bit in earth engagement. Hammer actuation of the cutting tool rapidly generates large quantities of debris in the form of rock chips, dust, soil, sand and the like. Compressed air supplied to drive the hammer is exhausted near the cutting tool and is relied upon to blow debris out of the annulus between the drill pipe and the borehole. The area of the annulus must be such that the velocity of the air and debris is at least 3000 feet per minute in order for the debris to be lifted effectively. Conventional machines for drilling rock use a drill pipe with a diameter of less than five inches and have approximately six hundred cubic feet of air per minute available and are effectiveliy limited to boreholes of seven inches in diameter or less.

It is known to use foam to increase the effectiveness of the air stream in somewhat larger diameter boreholes and it has also been known to use supplementary sources of compressed air.

It has also been known to use larger diameter drill pipe but this intended remedy is generally impractical unless the supply of compressed air is augmented. In large boreholes the cross sectional area between the drill pipe and the borehole is so great tht even if the drill pipe diameter approaches the borehole diameter, it is difficult to attain sufficient lifting velocity and there is insufficient room for the passage of the debris. Also, such expedient becomes very expensive since a different size drill pipe is required for each size of borehole and in order to maintain clearance for the cuttings, the air volume must be increases even proportionately greater than the increase in diameter.

Still further, the hammer and bit sometimes drop into a subterranean cavity or an excessively porous formation. When this happens, the compressed air is dissipated and suddenly unavailable to lift the debris out of the well. Under such circumstances and whenever the source of compressed air is shut down for any cause, the column of debris being lifted collapses about the drill pipe, hammer and bit. At best, this creates an extremely difficult condition under which to resume operations and at worst locks the drill pipe and hammer in the well where they must be abandoned at an appreciable loss of equipment and total destruction of the well drilled.

SUMMARY OF THE INVENTION

An object of the present invention is to provide an improved pneumatic drilling apparatus for wells and the like.

Another object is to make possible the pneumatic drilling of larger diameter boreholes while successfully evacuating drilling debris in an exhausting air stream.

Another object is to provide a well drillng apparatus which is capable of driling large diameter wells deeper and faster than conventional pneumatic drilling tools through the more effective removal of the debris generated by drilling operations.

Another object is to provide an improved pneumatic apparatus for removing debris generated by borehole drilling operations from the borehole being drilled.

Another object is to provide a pneumatically actuated drilling apparatus capable of effectively removing drilling debris from boreholes being drilled even though such boreholes pass through formations of extreme porosity and even subterranean cavities.

Another object is to reduce the expense of pneumatically drilled wells and the like by reducing the quantity of compressed air required.

Further objects and advantages are to provide improved elements and arrangements thereof in a pneumatically actuated drilling apparatus which is economical, durable, dependable and fully effective in performing its intended functions.

Still further objects and advantages will become apparent in the subsequent description in the specification.

DESCRIPTION OF THE PREFFERED EMBODIMENT

Figure 1:
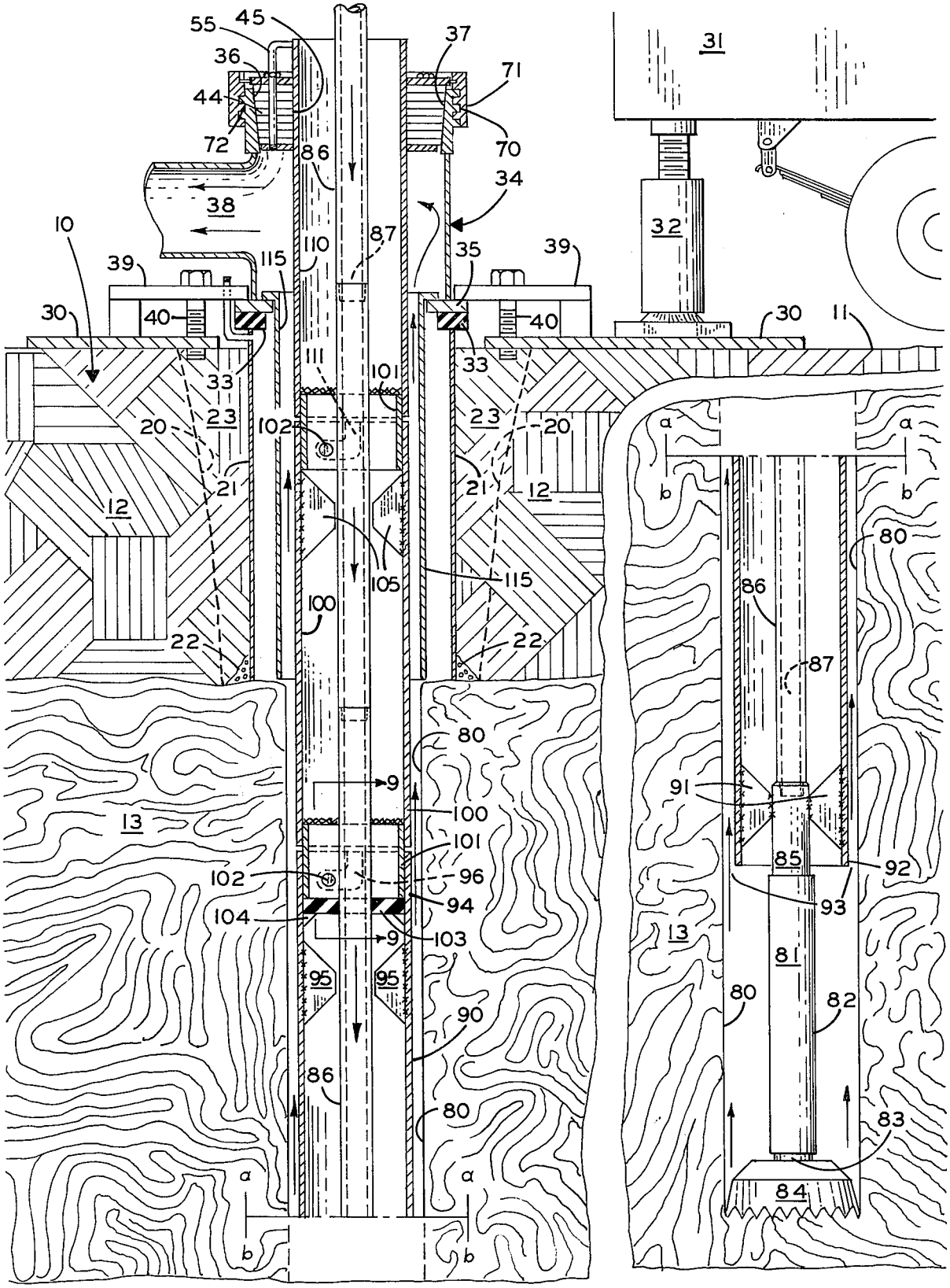
FIG. 1 is a vertical section of a borehole drilling apparatus embodying the principles of the present invention suspended in a borehole being drilled as configurated for preliminary drilling operations, said section being foreshortened by breaking away portions thereof and by showing the lower end of the apparatus along side of its central portion.
Figure 2:
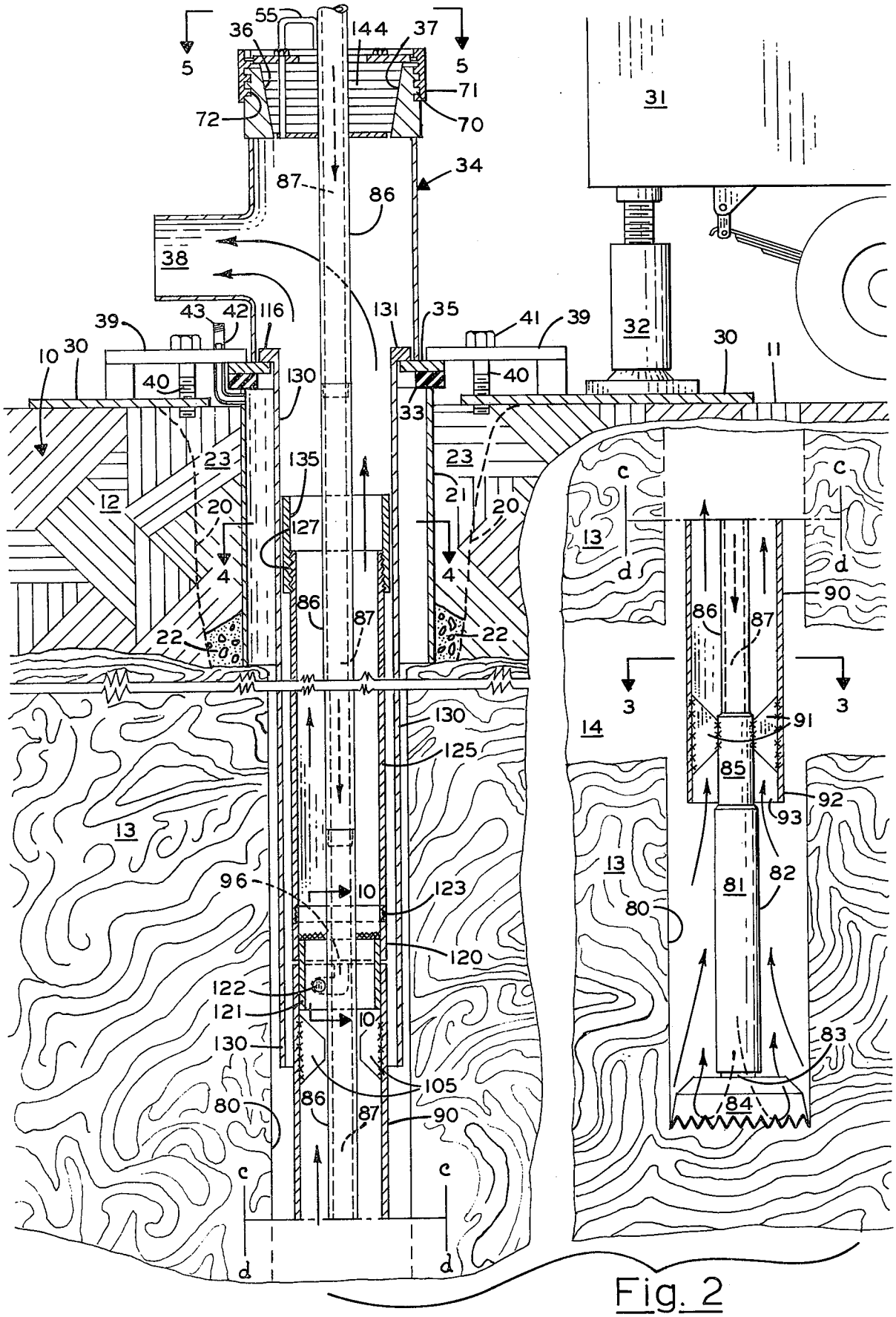
FIG. 2 is a similarly foreshortened vertical section but showing the configuration of the apparatus for subsequent deeper drilling utilizing the full effectiveness of the present invention.
Figure 3:
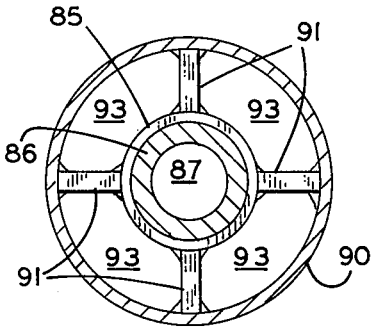
FIG. 3 is a transverse section taken at the position indicated by line 3—3 of FIG. 2.
Figure 4:
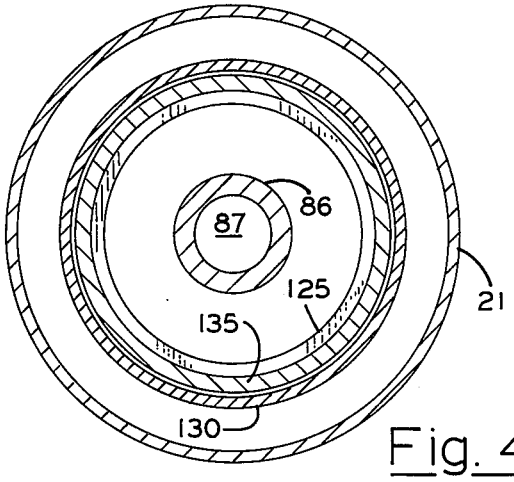
FIG. 4 is a transverse section taken at the position indicated by line 4—4 in FIG. 2.

Referring first to FIGS. 1 and 2, a typical section of the earth is represented generally at 10 having a surface 11, alluvial soil or burden 12, a rock formation 13 and an underground cavity 14 in the rock formation. Such is intended to typify the operational environment for the apparatus of the present invention.

Prior to the practice of the present invention, a pit 20 is dug in the surface 11 by any suitable means. The bottom of the pit is preferably dug down to the rock formation 13 or any other suitable compacted or consolidated material against which a seal can be achieved and dependable support obtained. A pipe 21 is positioned in an upright position in the pit 20, preferably rested on the rock formation 13, or the compacted or consolidated material, to which the lower end of the pipe is cemented at 22. The pit is then back-filled at 23 to the surface 11 adjacent to the upper end of the pipe 21.

Jack pads 30 are positioned on the surface 11 in adjacent relation to the upper end of the pipe 21 and are dependably held in position, as by supporting a truck 31 on a rig jack 32 rested on the pad. A compressible gasket 33 of rubber or other suitable material is rested on the upper end of the pipe 21. A discharge fitting or head 34 provides an annular base or ring 35 rested on the gasket 33, an upwardly disposed opening 36 circumscribed by a frusto-conical seat 37, axially aligned with the pipe 21, and a laterally extended discharge 38. The portion of the head providing the seat constitutes a socket member. Hold down clamps 39 are provided on the pad 30 and overlay the ring 35. Bolts 40 are weldably mounted on the pad and extend upwardly through openings in the clamps to receive nuts 41 tightened downwardly against the clamps to compress the ring into air-tight engagement with the gasket 33. Optionally, a tube 42 is connected to the pipe 21 and upwardly extended to a connector 43 through which water or air under pressure can be introduced into the pipe to assist drilling operations and debris removal as will subsequently be apparent.

Figure 5:
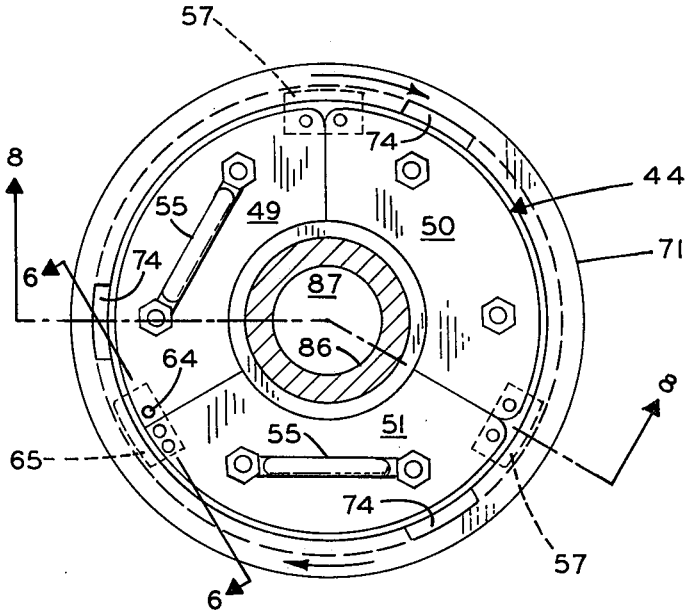
FIG. 5 is a transverse section taken at the position indicated by line 5—5 in FIG. 2.
Figure 6:
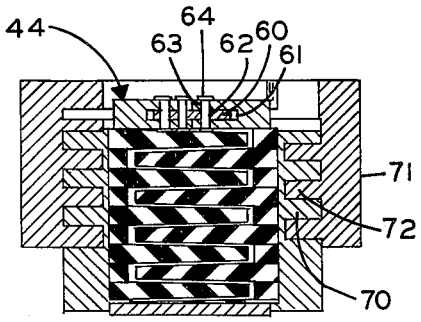
FIG. 6 is a fragmentary vertical section taken on line 6—6 of FIG. 5.
Figure 7:
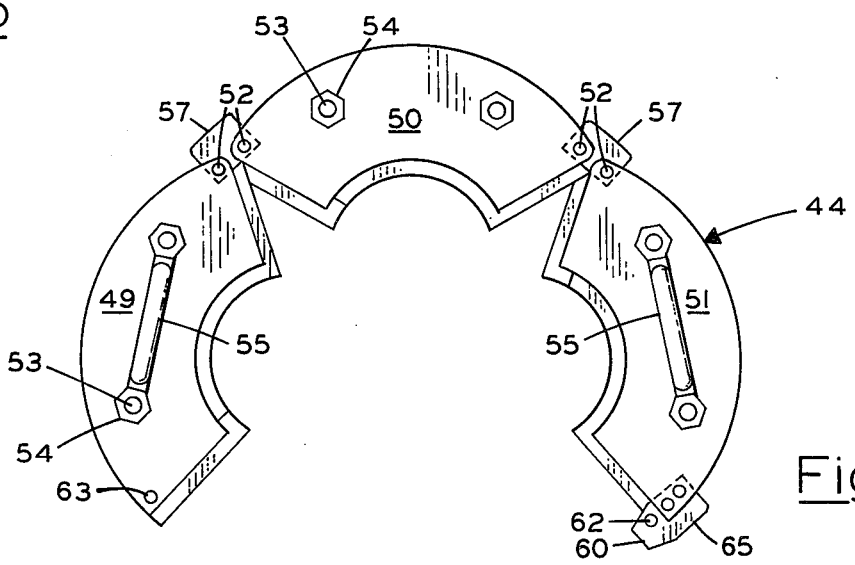
FIG. 7 is a view similar to FIG. 5 but with a releasable seal shown therein in released condition.
Figure 8:
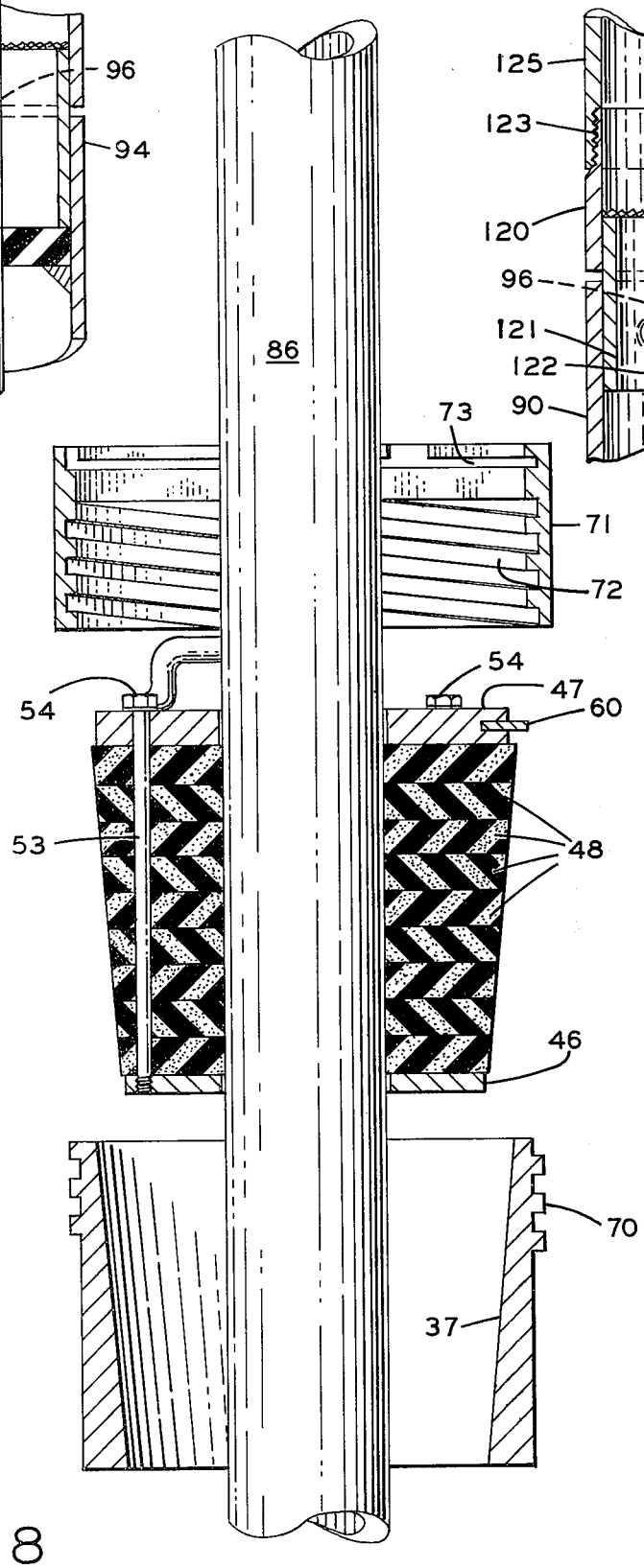
FIG. 8 is an angular vertical section taken on line 8—8 of FIG. 5.

As generally show in FIG. 1 and more particularly in FIGS. 5 through 8, a frusto-conical seal or packing ring 44 having a central bore 45 is releasably seated in the seat 37. The seal has an annular base plate 46, an annular top plate 47 of a diameter greater than the base plate and a plurality of laminae 48 of compressible material sandwiched between the plates 46 and 47. As shown in FIGS. 5 and 7, the plates 46 and 47 and laminae 48 are divided into three arcuate segments 49, 50 and 51. Hinges 52 pivotally interconnect the segment 49 with the segment 50 and the segment 50 with the segment 51 for relative movement of the segments between the closed position of FIG. 5 and the open position of FIG. 7. A pair of bolts 53 are extended through the top plate 47 of each of the segments 49, 50 and 51 and the laminae 48 and screw-threadably engaged in the segments of the base plate 46, as shown in FIG. 8. Nuts 54 are provided on the upper ends of the bolts 53 for tightened engagement against the top plate 47 to compress the laminae 48, as desired. For convenience of manipulation, handles 55 bridge the upper ends of the bolts 53 of the respective segments 49 and 51 and are held on their respective bolts by the nuts 54. Each of the hinges 52 has an edge or lug 57 which projects outwardly from its respective segment of the upper plate 47.

As shown in FIGS. 5, 6, and 7, a tongue 60 is rigidly mounted in the top plate 47 of the segment 51 and extends into a slot 61 in the top plate of the segment 49 when the segments are closed. Aligned bores 62 and 63 are formed through the tongue 60 and the top plate 47 of the segment 49 releasably to receive a pin 64 to hold the segments in closed position. Like the hinges 52, the tongue 60 has an outer edge extended beyond the periphery of the top plate 47 to provide a lug 65. As best shown in FIG. 8, the upper end of the seat 37 is provided with a male screw thread 70. When the segments 49, 50 and 51 of the seal are closed, the seal nests downwardly in the seat 37. An annular cap 71 fits downwardly over the screw threads 70 and provides internal screw threads 72 which engage with the screw threads 70. The screw threads 70 and 72 are preferably triple lead threads for tightening in less than a third of a turn. The upper end of the cap has an inwardly disposed groove 73 adjacent to its upper end having three upwardly extended access openings 74 positioned to receive the lugs 57 and 65. When the lugs are received in their respective access openings, a slight rotation of the cap 71 serves to compress the seal 44 downwardly in the seat 37 into air-tight engagement therewith.

Referring to FIGS. 1 and 2, a borehole formed by the apparatus of the present invention is shown at 80. As illustrated, an air hammer 81 of well known form is shown at the bottom of the borehole and has a cylinder 82 having a reciprocal piston, not shown, mounted therein having driving connection to an axially extended shaft 83 which mounts a chisel or bit 84. The cylinder 82 has an overall diameter substantially less than the width of the bit 84.

A coupler 85 is screw-threadably connected to the upper end of the hammer 81. A drill pipe 86 is screw-threadably connected to the upper end of the coupler 85 and, as will subsequently become apparent, consists of as many screw-threaded segments of selected length as desired. Usually, standard drill pipe is used. A compressed air passage 87 extends from any suitable source of compressed air, not shown, at the surface 11 through the segments of drill pipe 86, and the coupler 85 to the hammer 81 and thus supplies the compressed air needed to drive the hammer.

A tubular guide 90 having an internal diameter substantially greater than the external diameter of the drill pipe 86 and an external diameter substantially smaller than the internal diameter of the borehole 80, is mounted in concentric circumscribing relation on the coupler 85 and the lowermost segment of the drill pipe. Spacers 91 are radially extended from the coupler 85 to the guide and weldably affixed to each to fasten the guide to the coupler and to center the guide on the coupler. The guide has a lower end 92 adjacent to the hammer 81 and spaced therefrom to define an intake opening 93 utilized in the practice of the present invention. The guide has an upper end 94 in downwardly adjacent spaced relation to the upper end of the lowermost segment of drill pipe. Spacers 95 are mounted on in the upper end of the guide in engagement with the drill pipe to center the guide on the drill pipe. The upper end 94 is provided with J-slots 96 for purposes subsequently described.

Figure 9:
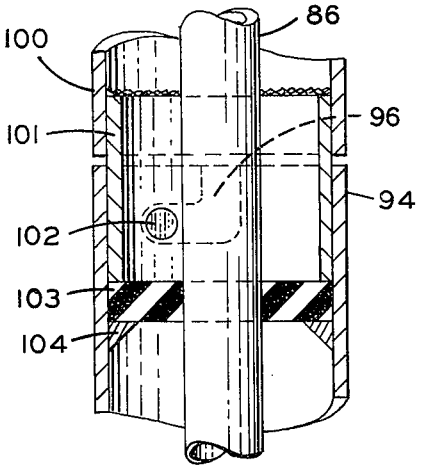
FIG. 9 is a section taken on line 9—9 of FIG. 1.

In FIG. 1, a first temporary guide extension 100 having the same diameter as the guide 90 is releasably connected to the upper end of the guide. As shown in FIGS. 1 and 9, a sleeve 101 has one end extended upwardly into the lower end of the temporary guide extension 100 to which it is welded and has an opposite end extended from the guide extension. The extended end of the sleeve slidably fits the upper end 94 of the guide 90 and bosses 102 are radially extended from the sleeve in positions for receipt in the J-slots 96. A removable seal 103 is mounted in the guide 90 by any suitable means in circumscribing relation to the drill pipe 86 at the lower end of the sleeve. As shown in FIG. 9, an annular ledge 104 is provided internally of the guide 90 adjacent to the lower end of the sleeve 101 so that when the boss 102 is located in the J-slot 96 the seal 103 is clamped between the lower end of the sleeve and the ledge. The seal 103 substantially blocks passage of air and debris upwardly between the guide and drill pipe but need not achieve completely air-tight integrity.

The upper end of the first temporary guide extension 100 is preferably provided with spacers 105 rigidly mounted on the conduit and slidably engaged with the drill pipe 86 to maintain concentricity therewith.

In the configuration of FIG. 1, a second temporary guide extension 110 is connected to the upper end of the first temporary guide extension 100 and upwardly extended therefrom. Except for the seal 103, the extension 110 is identical to the extension 100 and similar portions are identified by the same numbers in the drawings. J-slots 111 are provided in the upper ends of the temporary guide extensions 100 and 110 releasably to receive the bosses 102 of any guide extensions utilized thereabove. Any number of temporary guide extensions may be utilized but sufficient should be employed so that the upper guide extension extends through the seal 44.

In FIG. 1, a temporary pipe 115 of substantially the same diameter as that of the borehole 80, has a circumscribing flange 116 at its upper end rested on the ring 35 with the pipe suspended therefrom. For ease of assembly, the outer diameter of the flange 116 is less than the minimum diameter of the seat 37 so that the temporary pipe can be passed downwardly through or drawn upwardly through the seat 37.

Figure 10:
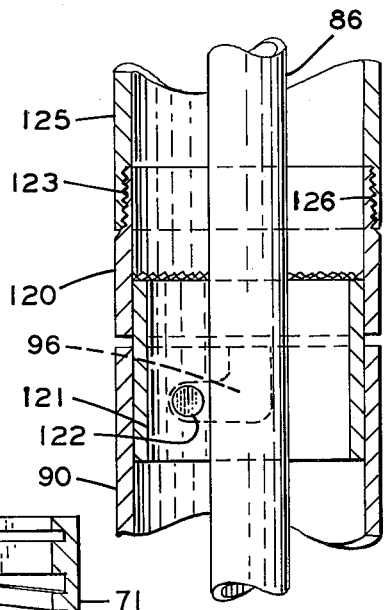
FIG. 10 is a section taken on line 10—10 of FIG. 2.

In the configuration of FIG. 2, it will be noted that the temporary guide extensions 100 and 100 have been disconnected from the guide 90 and the seal 103 removed from the guide. As best shown in FIG. 10, an adapter 120 has a cylindrical lower end 121 telescopically fitted to the upper end of the guide 90 providing radially extended bosses 122 releasably received by the J-slots 96 to connect to the guide. The adapter has an upper end 123 provided with left-hand male screw threads.

As best shown in FIG. 2, any desired number of conduits 125 are connected in series to the adapter 120. Each conduit has a female screw-threaded lower end 126 and a male screw-threaded upper end 127. The screw threads are preferably left-handed, the female threads being adapted to engage the male threads of the adapter or of the upper end of another length of conduit. Each length of conduit 125 is preferably the same length as each length of drill pipe 86. Conventional drill pipes normally come in twenty foot lengths (6.08 meters) and this is suitable for the purpose.

As configurated in FIG. 2, a slip discharge conduit 130 which is of an inside diameter substantially greater than the outside diameter of the drill pipe 86 and which is of an outside diameter substantially less than the inside diameter of the borehole 80 has a circumscribing flange 131 at its upper end rested on the ring 35 and is suspended in the borehole 80 in circumscribing relation to the drill pipe.

The upper end 127 of the uppermost conduit 125 has a collar 135 screw-threadably mounted thereon. The collar provides a sliding seal between the conduit on which it is mounted and the slip discharge conduit 130. As will subsequently become apparent, as drilling operations proceed, the drill pipe 86 descends in the borehole 80, the coupler 85 and guide 90 correspondingly descend and carry the interconnected lengths of conduit 125 downwardly with them. As this occurs, the seal formed by the collar 135 correspondingly descends in the slip discharge conduit 130. When the upper end 127 of an uppermost length of conduit 125 moves downwardly to a position adjacent to the seal 44, so that a new length of drill pipe must be connected, the collar 135 will have moved downwardly in the slip discharge conduit 130. Thus, the slip discharge conduit is preferably slightly longer than the length of drill pipe, 10 percent longer being excellently suited to the purpose. While the collar 135 is alluded to as forming a seal, it is not necessary that a good seal be achieved. It is sufficient that it constitutes an effective barrier between the conduit 125 and the slip discharge conduit 130.

OPERATION

The operation of the described embodiment of the present invention is believed to be readily apparent and is briefly summarized at this point. After the pipe 21 is cemented into position and the pit 20 has been filled about the pipe, the jack pads 30 are positioned, the ring 35 of the head 34 is positioned on the gasket 33 rested on the upper end of the pipe, and the nuts 41 of the clamps 39 are tightened dependably to hold the head in position. The seal 44 is removed from the seat 37, the jack hammer 81 is connected to the coupler 85 which mounts the guide 90 and a first length of drill pipe 86 is lowered through the seat 37 within the pipe 115 and connected to the coupler 85. In such condition, the bit 84 is rested on the bottom of the pre-dug pit 20 with the guide 90 and the upper end of the drill pipe 86 extended above the head 34. The seal 44 is clamped about the guide and engaged with the seat 37. The drill pipe is connected to any suitable source of air under pressure and compressed air is forced down the passage 87 in the drill pipe 86 to actuate the hammer 81 causing the bit 84 to initiate drilling of the borehole 80. The air released by the hammer carries the debris generated by the bit upwardly through the annular passage between the guide 90 and the walls of the borehole. Such air and debris then pass upwardly between the guide 90 and the pipe 115 and is vented through the discharge 38 of the fitting 34. This annular passage between the guide and the walls of the borehole as well as between the guide and the pipe is sufficiently constricted to achieve a high velocity of air movement upwardly therethrough. It should be noted that the debris in the configuration of FIG. 1 cannot pass upwardly between the guide 90 and the drill pipe 86 because of the seal 103. It, of course, has been known to blow drilling debris upwardly between a drill pipe and the wall of a borehole in which it is situated.

The drilling continues until the upper end of the guide 90 approaches the seal 44. The first temporary guide extension 100 is then connected to the upper end of the guide 90 by means of the engagement of the bosses 102 in the J-slots 96 and a half length of drill pipe 86 connected to the first length of such drill pipe. The temporary guide extensions 100 and 110 are approximately half the length of a normal length of drill pipe 86 and are used with the half lengths of drill pipe so as to be short enough to be accommodated by the derrick or rig, not shown, used in the operation and so that the half lengths of drill pipe can be lifted high enough to slip into the temporary guide extensions while the temporary guide extensions and guide 90 are substantially vertical.

Whenever it is desired to add a temporary guide extension 100 or 110 or a section of drill pipe 86, the pin 64 is removed from its bores 62 and 63 in the seal 44, the annular cap 71 is released by rotating it, and by grasping the handles 55 the seal is lifted from the seat 37 and the segments pivoted outwardly as shown in FIG. 7 to remove the seal from the drill pipe 86. The temporary guide extensions, half and full lengths of drill pipe 86, and pipe 115 and slip discharge conduit 130 can be inserted through the seat into position or removed therefrom, as desired. Subsequent to such an operation, the seal 44 is placed back around the temporary guide extension.

The preliminary drilling with the debris being blown upwardly between the guide 90 and the inner wall of the borehole 80 usually continues until three temporary guide extensions 100 and 110 have been added to the guide 90 in order to get the borehole drilled to a sufficient depth to shift to the configuration shown in FIG. 2. At that point, the seal 44 is removed, as before and the three guide extensions 100 and 110 together with the pipe 115 and the seal 103 are removed. It will be apparent that in the configuration of FIG. 1 with the compressed air lifting the debris in the annular passage between the guide 90 and the wall of the borehole, the system is subject to the disadvantages of the prior art. This is tolerated only for a depth of drilling sufficient to make shifting to the configuration of FIG. 2 practical.

When the seal 44, the three temporary guide extensions 100 and 110, the pipe 115, and the seal 103 have been removed, the first length of drill pipe 86 supporting the coupler 85, guide 90, and air hammer 81 is lowered into the borehole 80 until the upper end of the first section of drill pipe is upwardly adjacent to the head 34. A slip, now shown, but well known in the art for use in clamping and supporting pipes and the like, is clamped about the upper end of the guide 90 and rested on the seat 37 supporting the guide, coupler, air hammer, and first length of drill pipe 86 thereon. The slip is preferably of a form which fits into the seat 37. Another length of drill pipe 86 is screwed into the first length, the slip is released and the length of drill pipe lowered by any suitable means into the borehole until the bit 84 rests on the bottom thereof. The drill pipe by which the train of drill pipe sections has been lowered into the borehole, is then disconnected near the surface 11 leaving the drill pipe standing freely in the hole. The slip discharge conduit 130 is then lowered into position and supported on the ring 35. Additional lengths, or half lengths, of conduit 125 are then connected to the adapter 120, slid downwardly over th drill pipe 86 standing freely in the borehole. The drill pipe 86 is conventional and thus has right-hand threads. The J-slots 96 and the screw threads between successive lengths of the conduit 125, are left-handed so they do not unscrew when the drill pipe is rotated. The string of conduit 125 is then suspended from the top of the head 34 by slips, not shown, and the drill pipe 86 is connected to a top head drive of the associated drilling rig, not shown, along with one additional joint of drill pipe. The entire string of drill pipe 86, air hammer 81, and guide 90 are then picked up by the drill pipe. When the conduit is lifted by the top of the guide 90, the conduit is rotated counterclockwise until the adapter 120 engages and is locked into the top of the guide by engagement of the bosses 102 in the J-slots 96.

The collar 135 is screw-threadably mounted on the upper end 127 of the uppermost length of conduit 125. The slips are then removed and the drill pipe and associated conduit lowered until the collar is received by the upper end of the slip discharge conduit 130. A seal or packing ring 144, identical to the seal 44 except having an internal opening slidably fitted to the drill pipe 86, is installed in the seat 37.

The conduit 125, guide 90, and air hammer 81 are lowered into the borehole 80 until the bit 84 engages the bottom thereof. Compressed air is supplied to the air hammer through the passage 87 and the air hammer is actuated to drill the formation at the bottom of the borehole. As the bit dislodges rock chips and other debris, the compressed air emitted by the hammer blows such chips and debris through the opening 93 into the annular passage between the guide 90 and the drill pipe 86. As before, this passage is small enough in its transverse dimensions, that the exhausting air has a high velocity therethrough. The exhaust of such air and debris continues up the annular passage between the conduits 125 and the drill pipe 86 and out the discharge 38 of the head 34.

When the drilling has progressed to the point that the collar 135 approaches the lower end of the slip discharge conduit 130, the upper end of the last length of drill pipe 86 is below the seal 144. The supply of compressed air to the passage 87 is interrupted after substantially all of the debris generated by the bit 84 has been blown from the discharge 38. The seal 144 is moved upwardly from the seat 37 and opened, as shown in FIG. 7, for removal from the drill pipe 86. Next, the drill pipe is drawn upwardly until the collar 135 emerges from the seat 37. The collar 135 is then removed from the uppermost length of conduit. The drill pipe is lowered and rested on the bottom of the borehole. A length of conduit 125 is then lowered into the borehole and supported on slips rested on seat 37 and the collar mounted on the upper end thereof. An additional length of drill pipe is then connected to the string thereof rested in the borehole and the resultant string raised until the upper end of the string of conduit engages the lower end of the length of conduit supported by the slips and the added length of conduit is then connected to the string. The slips are then removed and the drill pipe lowered to lower the string of conduit 125 until the collar 135 enters the upper end of the slip discharge conduit 130. The seal 144 is returned to position in the seat 37 about the drill pipe and the drilling action is resumed.

When the bit 84 reaches a cavity, such as that shown at 14 or an excessively porous formation, the hammer 81, drill pipe 86, guide 90, and conduit 125 are withdrawn from the borehole 80 and a slug of concrete poured down the borehole to seal off the cavity. When the concrete has hardened, the air hammer, drill pipe, guide, and conduit are returned to the borehole and the hammer actuated to drill through the concrete.

To remove the equipment from the borehole 80, the seal 144 is removed and the drill pipe 86 raised to bring the upper length of conduit 125 to a position extended to a short distance above the seat 37. Slips are then employed to clamp the conduit 125 and the drill pipe rotated briefly to disengage the bosses 102 from the J-slots 96. The drill pipe is then lowered to rest the bit 84 on the bottom of the borehole. The drill pipe 86 is disconnected from the drilling rig, not shown, and the lengths of conduit 125 successively removed and disconnected. Thereafter, the drill pipe 86, coupler 85, guide 90 and air hammer 81 are removed from the borehole.

In actual operation, the drilling apparatus of the present invention has proved capable of speedily drilling boreholes even in formations so porous that conventional pneumatic drilling has failed. Blowing the exhaust air from the air hammer 81 up the restricted annulus between the drill pipe 86 and the guide 90 and conduit 125, achieves a more effective removal of debris from the borehole. This is a result of the high velocity achieved in the confined annulus as constrasted with that attainable in an unrestricted borehole. Thus, the conventional need for vast quantities of supplementary compressed air is eliminated. In one instance, the apparatus of the present invention succeeded in 3 days in drilling a successful water well in a formation in which virtually continuous effort had been made with conventional equipment for over a month to drill a well in the same formation. The drilling apparatus of the present invention uses far less energy, drills, and expells the drilling debris much more rapidly, and is much more reliable than other known drilling apparatus. Further, the apparatus of the present invention can successfully drill large diameter boreholes in formations and to depths which cannot be drilled by conventional pneumatic drilling apparatus.

If desired, water or compressed air can be introduced into the borehole 80 through the tube 42. Such augmenting water or air pressure, even of a low pressure, assists in forcing the chips and debris up the passage between the drill pipe 86 and the guide 90 and conduit 125 but is not required for successful operation.

Although the invention has been herein shown and described in what is conceived to be the most practical and preferred embodiment, it is recognized that departures may be made therefrom within the scope of the invention.

Having described my invention, what I claim as new and desire to secure by Letters Patent is:

1. A well drilling apparatus comprising:

A. a slip discharge conduit,

B. means mounting the slip discharge conduit in a fixed upright position in the ground in substantially air-tight relation therewith, C. discharge means connected to the slip discharge conduit and laterally extended therefrom above the surface of the ground, D. an elongated drill pipe extended through the slip discharge conduit for elevational movement relative thereto having an end above the conduit adapted for connection to a source of air under pressure and an end below the conduit, E. a pneumatically actuated hammer mounted on the lower end of the drill pipe adapted to release compressed air from the drill pipe therethrough having the drill pipe supported thereon for elevational movement therewith, F. a debris conduit mounted in circumscribing relation on the drill pipe for elevational movement therewith and defining a passage therebetween having an upper end disposed in the slip discharge conduit and an open lower end adjacent to the hammer to receive air released by the hammer and debris generated thereby, and g. a sliding seal between the slip discharge conduit and the upper end of the debris conduit to force said air and debris up the passage and out the laterally extended discharge means.

2. A well drilling apparatus comprising:

A. a head mounted on the ground having a downwardly disposed opening, a laterally disposed discharge, and an upwardly disposed opening circumscribed by a seat;

B. a slip discharge conduit mounted in the head and downwardly extended from the downwardly disposed opening of the head;

C. a drill pipe having a longitudinally extended compressed air passage extended through the slip discharge conduit having an upper end extended upwardly out of the seat and a lower end below the slip discharge conduit;

D. a pneumatic hammer mounted on the lower end of the drill pipe in supporting relation to the drill pie for actuation by compessed air supplied therethrough and for release of the compressed air therefrom;

E. a bit mounted on the hammer in supporting relation thereto for operation by the hammer;

F. a debris conduit mounted in spaced circumscribing relation on the drill pipe for elevational movement therewith defining an exhaust passage therebetween having an open upper end in the slip discharge conduit and an open lower end adjacent to the bit;

G. a sliding seal between the upper end of the debris conduit and the slip discharge conduit to obstruct passage of air and debris therebetween; and H. a removable seal engaged with the seat of the head and slidably engaged with the drill pipe.

3. The drilling apparatus of claim 2 in which the seal between the seat and the drill pipe is split for ease of removal and replacement to accommodate the installation and removal of the drill pipe and debris conduit longitudinally through the head.

4. The drilling apparatus of claim 2 in which the seat is frusto-conical and the seal between the seat and the drill pipe comprises:

A. a segmented resiliently compressible packing ring having a periphery fitted to the seat, a central opening fitted to the drill pipe, and peripherally extended rigid lugs, and B. a collar screw-threadedly mounted on the head in circumscribing relation to the seat engageable with the lugs of the packing ring to compress the ring into the socket member.

5. The drilling apparatus of claim 2 in which the packing ring comprises a plurality of arcuate segments, and means pivotally interconnecting the segments for pivotal movement about axes substantially parallel to the axis of the seat, one of said means being removable to release its adjacent segments for pivotal separation.

6. The drilling apparatus of claim 5 in which the segments of the packing ring are laminated in planes normal to said axes and the laminae of adjacent segments overlap and are interlaced.

7. Th drilling apparatus of claim 6 in which the segments of the packing ring are sandwiched between plates of rigid material, and including means to compress the plates toward each other to compress the segments and tighten their engagement in the socket member.

8. A split seal adapted to provide substantially fluid tight integrity between a first conduit and a second conduit in concentric circumscribing relation to the first conduit comprising:

A. a socket member mounted on the second conduit and endwardly extended therefrom providing an endwardly distended frusto-conical seat;

B. a segmented resiliently compressible packing ring having a periphery fitted to the seat of the socket member, a central opening fitted to the first conduit, and peripherally extended rigid lugs in endwardly spaced relation to the socket member; and C. a collar screw-threadedly mounted on the socket member engageable with the lugs of the packing ring to compress the ring into the socket member.

9. The split seal of claim 8 in which the packing ring comprises a plurality of arcuate segments, and means pivotally interconnecting the segments for pivotal movement about axes substantially parallel to the axis of the seat, one of said means being removable to release its adjacent segements for pivotal separation.

10. The split seal of claim 9 in which the segments are laminated in planes normal to said axes and the laminae of adjacent segments overlap and are interlaced.

11. The split seal of claim 8 in which the segments of the packing ring are sandwiched between plates of rigid material and includiing means to compress the plates toward each other to compress the segments and tighten their engagement in the socket member.

12. A well drilling apparatus comprising:

A. a slip discharge conduit mounted in substantially fixed erect position in a borehole in substantially air tight engagement therewith, B. a drill pipe extended through the slip discharge conduit having an upper end above the slip discharge conduit and a lower end below the slip discharge conduit, C. a pneumatic drill mounted on the lower end of the drill pipe in supporting relation thereto for actuation by compressed air supplied to it through the drill pipe and for release of compressed air therethrough, D. a debris conduit supported on the drill for elevational movement therewith having an intake end adjacent to the drill and an exhaust end within the slip discharge conduit, and E. a sliding seal between the debris conduit and the slip discharge conduit.

* * * * *

UNITED STATES PATENT AND TRADEMARK OFFICE

CERTIFICATE OF CORRECTION

PATENT NO. : 4,031,970

DATED : June 28, 1977

INVENTOR(S) : Billie Belknap

It is certified that error appears in the above-identified patent and that said Letters Patent are hereby corrected as shown below:

Column 1, At the end of line 50 and the beginning of line 51, delete "effectiveliy" and insert --- effectively ---.

Column 2, line 1, delete "increases" and insert --- increased ---.

Line 15, after "well" and before "drilled" insert --- being ---.

Column 3, Line 50, delete "show" and insert --- shown ---.

Column 4, line 66, after "mounted" delete "on".

Column 5, line 51, after "and" delete "100" and insert --- 110 ---.

Column 7, Line 53, delete "now" and insert --- not ---.

Column 8, line 1, delete "th" and insert --- the ---.

Column 9, line 28, delete "constrasted" and insert --- contrasted ---.

Column 10, line 15, before "a sliding seal" delete "g." and insert --- G. ---.

UNITED STATES PATENT AND TRADEMARK OFFICE

CERTIFICATE OF CORRECTION

PATENT NO. : 4,031,970
DATED : June 28, 1977
INVENTOR(S) : Billie Belknap

It is certified that error appears in the above-identified patent and that said Letters Patent are hereby corrected as shown below:

Page 2 of the Certificate of Correction:

Column 10, line 33, after "drill" in the second instance, delete "pie" and insert --- pipe ---.

Column 11, line 8, before "drilling" delete "Th" and insert --- The ---.

Column 12, line 9, delete "includiing" and insert --- including ---.

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*